US006201459B1

(12) United States Patent
Ioffe et al.

(10) Patent No.: US 6,201,459 B1
(45) Date of Patent: Mar. 13, 2001

(54) TRANSMISSION LINE WITH VOLTAGE CONTROLLED IMPEDANCE AND LENGTH

(76) Inventors: Valery Moiseevich Ioffe, Russian Federation, 630064, Novosibirsk, ul Novogodnyaya, d.16, kv.16 (RU); Askhat Ibragimovich Maksutov, 455037, Magnitgorsk, ul. 50 let Magnitki, RU d.62, kv.9 (RU)

( * ) Notice: Subject to any disclaimer, the term of this patent is extended or adjusted under 35 U.S.C. 154(b) by 0 days.

(21) Appl. No.: 09/331,925

(22) PCT Filed: Jul. 7, 1997

(86) PCT No.: PCT/RU97/00213

§ 371 Date: Jun. 29, 1999

§ 102(e) Date: Jun. 29, 1999

(87) PCT Pub. No.: WO98/07206

PCT Pub. Date: Feb. 19, 1998

(30) Foreign Application Priority Data

Aug. 14, 1996 (RU) ..... 96116797

(51) Int. Cl.[7] ..... H01P 3/08

(52) U.S. Cl. ..... 333/238; 333/246; 257/664

(58) Field of Search ..... 333/236, 238, 333/246, 164; 257/664

(56) References Cited

U.S. PATENT DOCUMENTS

| | | | |
|---|---|---|---|
| 3,445,793 | 5/1969 | Biard | 333/238 |
| 4,229,717 | 10/1980 | Krone et al. | 333/156 |
| 4,348,651 | 9/1982 | Reid | 333/262 |

FOREIGN PATENT DOCUMENTS

| | | |
|---|---|---|
| 0383193 A2 | 8/1990 | (EP) . |
| 902122 | 2/1982 | (SU) . |
| WO 95/31010 * | 11/1995 | (WO) . |

OTHER PUBLICATIONS

Computer–Aided Design of Microwave Circuits (K. C. Gupta; Ramesh Garg; and Rakesh Chadha), pp. 41 –43, 1987 (and English translation).

GaAs Devices and Circuits (Michael Shur) p. 405, 1987 (and English translation).

Electronics, An Encyclopedic Dictionary—pp. 253, 254 and 491, 1991 (and English translation).

* cited by examiner

*Primary Examiner*—Justin P. Bettendorf
(74) *Attorney, Agent, or Firm*—Hardaway/Mann IP Group

(57) ABSTRACT

Transmission lines have variable characteristic impedance and length which may also be integrated with modulators and switches. The external electrical voltage controls the number of loads connected to the transmission line as well as connecting required loads to the transmission line and to modulate the value of a load connected to the transmission line. The transmission line includes several twin-conductor transmission lines where one conductor (2) is a main conductor. The other conductors (11), including those with different lengths, are either connected to conductive parts (1) or spaced by a gap from the conductive parts (1). The transmission lines form an ohmic contact with a semiconductor layer (4) having an electronic or hole-type conductivity with a pre-formed non-rectifying contact. The conductive parts (1) may be formed at the beginning or at the end of the transmission line or, alternatively, at the beginning and at the end of the transmission line. A semiconductor layer and/or metallic layer is formed with another non-rectifying contact at the surface of the layer (4), wherein this new layer forms, together with the layer 4, a p-n junction and/or a Schottky barrier having a non-homogenous doping profile in a direction transverse to the parts (1).

6 Claims, 5 Drawing Sheets

TRANSMISSION LINE WITH VOLTAGE CONTROLLED IMPEDANCE AND LENGTH

This invention relates to electronic engineering and microelectronics, namely, to transmission lines. The invention can find application in constructing transmission lines with controlled characteristic impedance and length, and also as a switching device.

TECHNICAL FIELD

A transmission line is usually considered to mean a device enabling directionally transporting electric power or transmitting signals from one object to another. As a rule, a transmission line used in electrical and radio engineering appears as a system of wires or cables. Microwave-frequency microelectronics make use most frequently of a microstrip transmission line which is in fact a twin line, comprising two conductor strips between which an insulator or semi-insulator layer is placed (cf., e.g., "Electronics". An Encylcopaedic Dictionary, Moscow, Sovetskaya Entsiklopedia Publishers, 1991, pp. 253, 254, 491; Modern Gallium-Arsenide Based Devices by M. Shur, Moscow Mir Publishers, 1991, p. 405 (in Russian). A disadvantage inherent in all transmission lines resides in that such line parameters as characteristic impedance and length cannot be controlled by an external voltage source, which impedes microminiaturization, adjustment, frequency retuning, and matching of numerous microwave-frequency microelectronic devices.

DISCLOSURE OF THE INVENTION

The present invention has for its primary and essential object to provide a unique and unprecedented transmission line featuring its characteristic impedance and length controlled by an externally applied voltage, as well as to provide such a line voltage that enables one to control, with the aid of an externally applied voltage, the number of loads connected to the transmission line and to connect thereto, using an externally applied voltage, a required load, as well as to modulate, using a control voltage, the value of a load connected to the transmission line.

The foregoing object is accomplished due to the fact that a transmission line, comprising a number of twin lines having one common conductor and other conductors, including areas 1 that establish, together with an electronic- or hole-type semiconductor layer, an ohmic contact, or are in a spaced relation to the conductor areas 1 formed either at the beginning or end of the transmission line, or both at the beginning and end of the transmission line, on the surface of an electronic- or hole-type semiconductor layer with a formed nonrectifying contact, a semiconductor and/or metallic region is established, having another nonrectifying contact and establishing, together with the aforementioned semiconductor layer, a p-n junction and/or a Schottky barrier featuring a doping profile nonuniform along the directon intersecting the conductor areas 1; when the conductors are in a spaced relation to the conductor areas 1, another electronic- or hole-type semiconductor layer having is provided above the clearance between said conductors and the conductor areas 1, said semiconductor layer having a formed nonrectifying contact and carrying a p-n junction and/or a Schottky barrier formed on its surface, said junction of barrier featuring a doping profile nonuniform along the direction intersecting the conductor areas 1 with an another nonrectifying contact, while selecting the characteristic impedance and the length of the transmission line is determined by the voltage values effective across the p-n junctions and/or Schottky barriers.

In addition, the proposed transmission line may be characterized in that an insulator layer is provided above the conductor areas and contacts with semiconductor regions, or such insulator layer is provided between the contacts with the semiconductor regions.

Thus, the essence of the invention resides in utilizing a possibility of changing, with the aid of an externally applied bias, the number of twin lines constituting a transmission line.

BRIEF DESCRIPTION OF DRAWINGS AND CHARTS

In what follows the present invention is explained in the disclosure of exemplary embodiments thereof given by way of illustration to be taken in conjunction with the accompanying drawings and charts, wherein.

Figure 1:
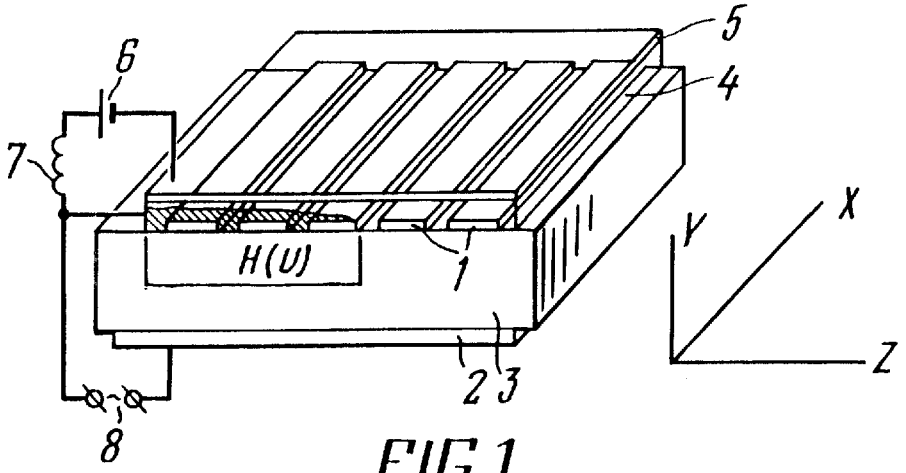
FIG. 1 illustrates a transmission line featuring a variable characteristic impedance and having a source of an input signal and a control voltage source.

For the sake of better understanding of the proposed controlled transmission line reference is now directed to FIG. 1 representing one of the embodiments of said line, comprising conductor strips 1, a conductor strip 2 which establishes, together with the areas 1, twin lines, an insulator layer 3, a semiconductor layer 4 provided with an ohmic contact and modulation-doped with n-type impurities across the transmission line width, a region 5 provided with an ohmic contact and establishing, together with the layer 4, a p-n junction or a Schottky barrier. FIG. 1 displays also a control voltage source 6 connected to the p-n junction via a reactor 7 aimed at alternating-current decoupling of the circuits of the input signal source and the control voltage, and an input signal source 8. An n-type layer 4 is formed over the conductor strips 1 to establish an ohmic contact together therewith, said layer 4 being modulation-doped across the transmission line width (that is, along the direction (Z) intersecting the conductor strips 1), the degree of doping decreasing as the value of Z increases. Established over the layer 4 is the region 5 having an ohmic contact and forming a p-n junction or a Schottky barrier together with the region 4. As the blocking voltage U (of the source 6) at said junction increases, the size of the neutrality region (H(U) in the n-type semiconductor along the direction Z decreases continuously, with the result that an effective width W of the transmission line follows the H(U) value with an increment equal to the width of the strips 1, which results in a proportional increase in the characteristic impedance of the transmission line ($\rho \sim 1/H(U)$).

Figure 2:
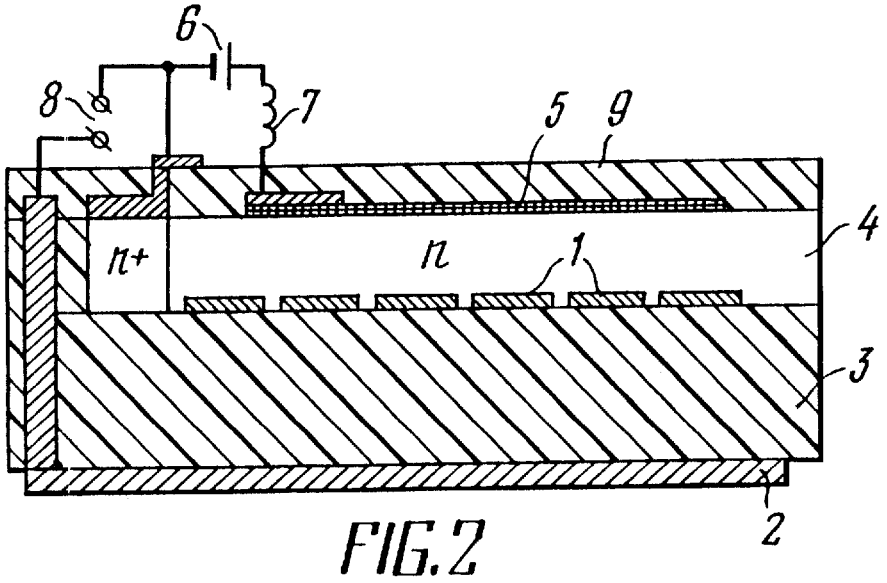
FIG. 2 illustrates a transmission line having variable characteristic impedance and manufactured according to planar fabrication technology.
Figure 3:
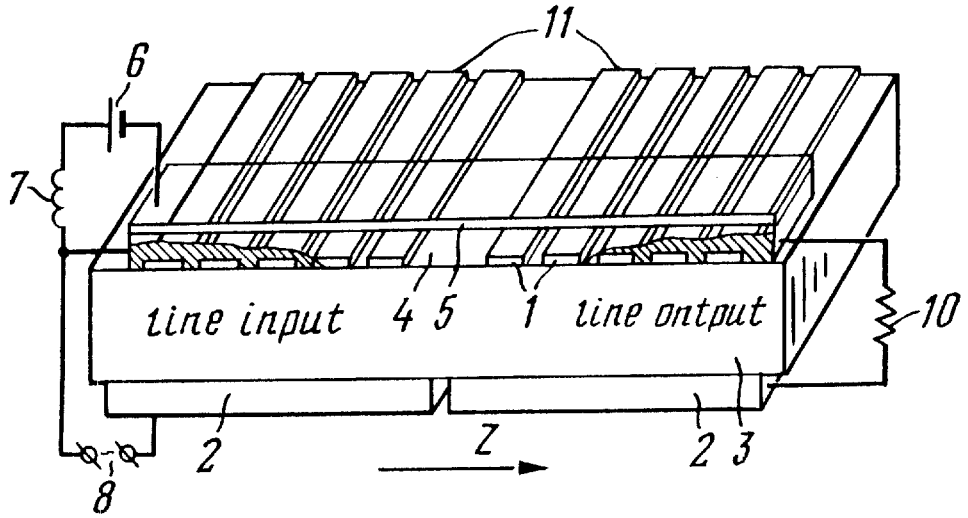
FIG. 3 illustrates a transmission line featuring variable characteristic impedance, having a p-n junction (or Schottky barrier) at the input and output thereof.

When manufacturing semiconductor devices using the planar-expitaxial technology, all contacts are as a rule formed on one of the surfaces of a semiconductor wafer and are isolated from one another with an insulator interlayer of silicon dioxide. FIG. 2 presents a controlled transmission line manufactured according to the planar-expitaxial technology. The line comprises (FIG. 2) conductor strips 1, a conductor strip 2, an insulator layer 3, a region 4 provided with an ohmic contact and modulation-doped with the n-type impurities across the transmission line width, a region 5 having an ohmic contact and establishing, together with the region 4, a p-n junction. FIG. 2 illustrates also a control voltage source 6 connected to the p-n junction via a reactor 7 aimed at alternating-current decoupling of the circuits of the input signal source and the control voltage, and an input signal source 8. The strips 1 are made from an Au—Sb alloy in order to establish an ohmic contact with the n-type semiconductor. Used as the insulant is silicon dioxide. Ohmic contacts with the p-region 5 and with the n-region 4 (heavily doped in the area of the contact), as well as the strip 2 all are made of aluminum. All of the contacts are isolated from one another with a silicon-dioxide protective layer 9. To prevent an undesirable effect of the capacitive coupling between the regions 1 and 5, the p-n junction (or Schottky barrier) may be established above some of the strips 1 (cf. FIG. 3 representing one of the embodiments of the proposed transmission line). According to said embodiment, the line comprises different-length conductors 11 (conductor areas 1 being the extensions to conductors 11), a conductor strip 2 (a common conductor forming twin lines together with the conductors 11,), an insulator layer 3, a region 4 having an ohmic contact and being modulation-doped with the n-type impurities across the line width, and a region 5 having an ohmic contact and establishing, together with the region 4, a p-n junction or a Schottky barrier. FIG. 3 illustrates also a control voltage source 6 connected to the p-n junction through a reactor 7 aimed at alternating-current decoupling of the circuits of the input signal source and the control voltage, an input signal source 8, and a load resistor 10 connected to the transmission line output. The p-n junction (or Schottky barrier) is provided both at the beginning and end of the transmission line, and the degree of doping of the film 4 increases at the line output along the direction Z (as the value of Z rises) and drops at the line input along the direction Z. Another way to rule out an undesirable effect of the capacitive coupling between the regions 1 and 5 consists in that both the n- and p-regions of the p-n junction are modulation-doped along the direction Z. As the control voltage rises the size of the neutrality region along the direction Z decreases both in the p- and n-regions.

Figure 4:
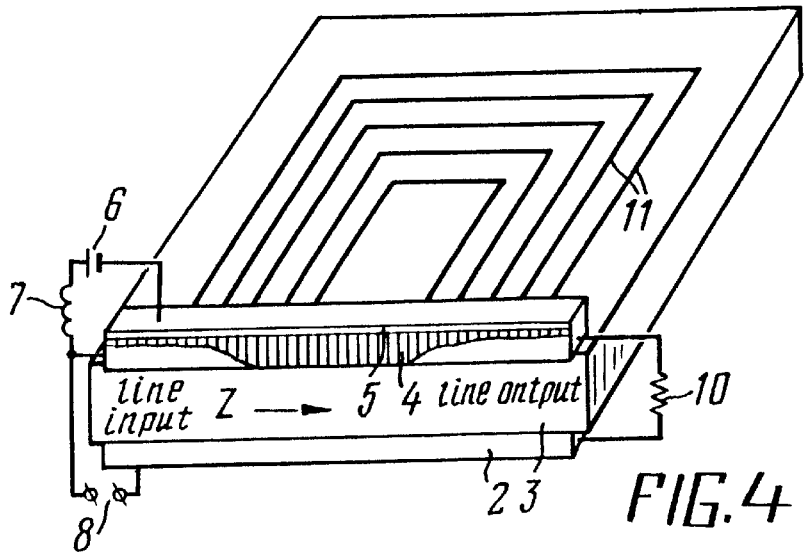
FIG. 4 illustrates a transmission line having variable characteristic impedance and length.

To illustrate the operation of the proposed transmission line, wherein both its characteristic impedance and length are variable, reference is now made to FIG. 4 which represents one of the embodiments of such transmission line. The line comprises conductors 11 which are connected, both at the input and output of the transmission line, to conductor areas 1, a conductor strip 2 (a common conductor forming twin lines together with the conductors 11), an insulator layer 3, a region 4 having an ohmic contact and being modulation-doped, across the width Z of the transmission line, with the n-type impurities, a region 5 having an ohmic contact and establishing, together with the region 4, a p-n junction or Schottky barrier. FIG. 4 illustrates also a control voltage source 6 connected to the p-n junction through a reactor 7 aimed at alternating-current decoupling of the circuits of the input signal source and the control voltage, an input signal source 8, and a load resistor 10 connected to the transmission line output. The p-n junction (or Schottky barrier) is provided both at the beginning and end of the transmission line, and the degree of doping of the film 4 increases at the line output along the direction Z (as the value of Z rises) and drops at the line input along the direction Z. As the blocking voltage U (of the source 6) at said junction increases, the size of the neutrality region (H(U) in the n-type semiconductor along the direction Z decreases continuously, with the result that an effective width W of the transmission line follows the H(U) value with an increment equal to the width of strips 1, which results in a proportional increase in the characteristic impedance of the transmission line ($\rho \sim 1/H(U)$). As the blocking voltage rises the line length increases gradually till a maximum length corresponding to the length of the strips 1. As a result, the space-charge region fills gradually the entire film 4.

Figure 5:
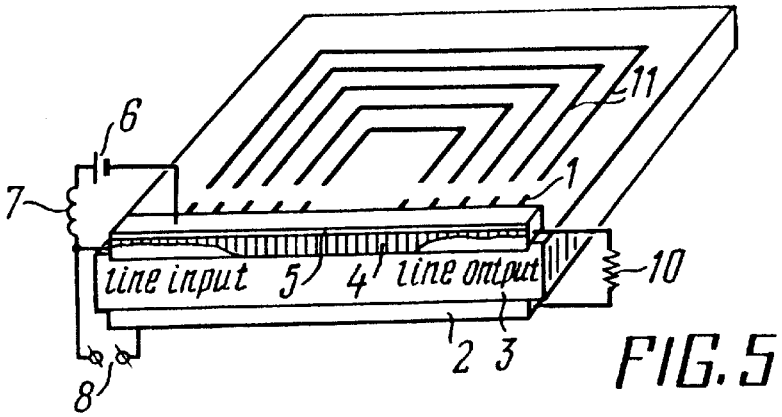
FIG. 5 illustrates a fragment of the transmission line having controlled characteristic impedance and length.
Figure 6:
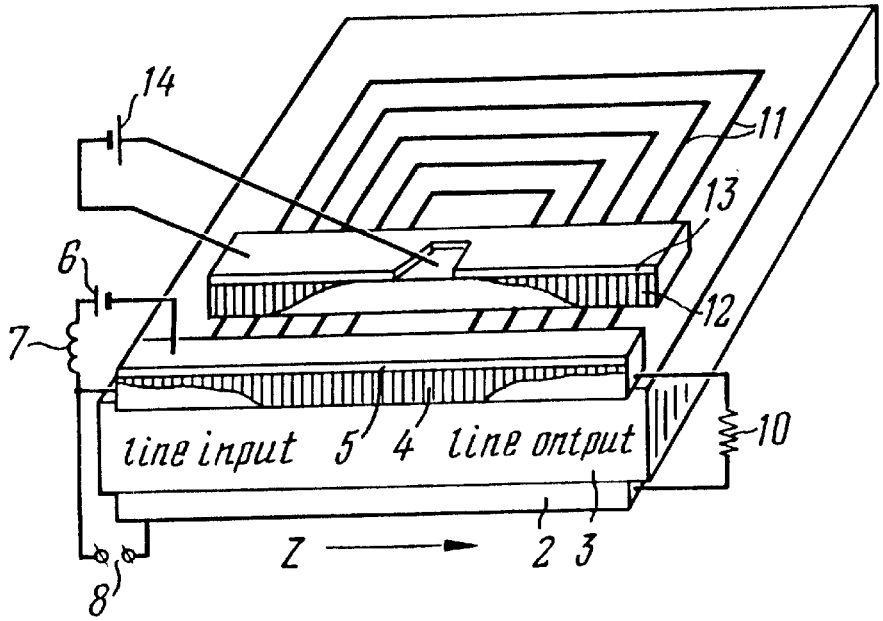
FIG. 6 illustrates an alternative embodiment of the transmission line having controlled characteristic impedance and length.

In order to effect simultaneous control both over the length and characteristic impedance of a transmission line, it is necessary that the conductor areas 1 be arranged in a spaced relation with respect to the conductors 11, and that a p-n junction or a Schottky barrier featuring nonuniform area-distribution of impurities be established over the clearance between the conductor areas 1 and the conductors 11. (FIGS. 5 and 6 present the structure of such a transmission line). The line comprises conductor areas 1 (conductors 11 being the extensions to the conductor areas 1), a conductor strip 2 (a common conductor forming twin lines together with the conductors 11), an insulator layer 3, a region 4 having an ohmic contact and being modulation-doped with the n-type impurities across the line width, and a region 5 having an ohmic contact and establishing, together with the region 4, a p-n junction or a Schottky barrier. FIG. 6 illustrates also a control voltage source 6 connected to the p-n junction through a reactor 7 aimed at alternating-current decoupling of the circuits of the input signal source and the control voltage, an input signal source 8, and a load resistor 10 connected to the transmission line output. The p-n junction (or Schottky barrier) is provided both at the beginning and end of the transmission line, and the degree of doping of the film 4 increases at the line output along the direction Z (i.e., along the direction intersecting the conductor areas 1) as the value of Z rises, and drops at the line input along the direction Z. The conductor areas 1 are arranged in a spaced relation with respect to the conductors 11 (FIG. 5), and a p-n junction or a Schottky barrier featuring nonuniform area-distribution of impurities (along the direction intersecting the conductor areas 1) is established over the clearance between the conductor areas 1 and the conductors 11 (FIG. 6). The p-n junction established above said clearance comprises a region 12 having an ohmic contact and being modulation-doped with the n-type impurities across the line width, and a region 13 having an ohmic contact and establishing, together with the region 12, a p-n junction or a Schottky barrier. Connected to said p-n junction is also a control voltage source 14. The degree of doping of the film 12 increases (above said clearance) at the line output along the direction Z as the value of Z rises, and drops at the line input along the direction Z. The film 12 is lightly doped in the interspaces between the conductors 11 which establish an ohmic contact together therewith and is depleted in majority charge carriers. With the zero value of control voltage of the source 14, the space charge region is spread over the entire thickness of the film 12 in the gaps between the conductors 11. Depending on the values of control voltage supplied by its sources, some conductor strips 1 or other get connected to the transmission line input and output through the neutrality region of the semiconductor films 4 and 12 (FIG. 6 represents a single such strip in the middle of the transmission line). It is evident that the films 4 and 12 may be manufactured as a single film (as well as films 5 and 13).

It is also noteworthy that the p-n junction having a nonuniform doping profile and formed by the layers 4 and 5 (or 12 and 13) may feature the layer 4 doped uniformly, whereas the layer 5 is modulation-doped along the direction intersecting the conductor areas 1 (or the layer 12 also modulation-doped along the direction intersecting the conductor areas 1 except for the portions between the conductors 11 which either are lightly doped or are made of an insulant). For the sake of definiteness, in the examples considered hereinbefore and in those which will be considered hereinafter the layers 4 and 12 feature the n-type conductivity. It is obvious that the layer 4, as well as the layer 12 may feature the p-type conductivity; in this case the layer 5 (13) should be made either of the n-type semiconductor or of a metal which establish, together with the layer 4, a p-n junction or a Schottky barrier; furthermore the layer 3 may be made of an insulant, or a semiconductor, or a semi-insulating semiconductor. In some instances the layer 3 may be dispensed with (whenever the conductor 11 is provided with an insulator coating or is adequately stiff; in this case used as an insulator layer between conductors may be an air gap). Evidently, the layer 4 or 12 may have homogeneous and inhomogeneous doping portions. Selection of a doping profile and thickness of the layer 4 (12) is restricted by a condition that there occurs a complete depletion of the layer 4 (12) or of a part thereof in major charge carriers till a breakdown of the p-n junction or Schottky barrier upon applying an external bias thereto:

$$q/\varepsilon_S \int_0^{d(x,z)} Ni(x, y, z)y\, dy - U_k < U_i,$$

where:

$U_i$—the breakdown voltage of the semiconductor layer 4 (12);

y—the coordinate originating in the metallurgical boundary of the p-n junction or Schottky barrier in the direction across the thickness of the layer 4 (12);

q—an elementary charge;

$N_i$ (x,y,z)—the doping profile in the film 4 or 12;

d(x,z)—the thickness of the film 4 or 12;

z, x—the coordinates on the surface of the layer 4 (12);

$\epsilon_s$—permittivity of the layer 4 (12);

$U_k$—built-in junction potential.

In this case the region 5 (13) may be doped with uniform and nonuniform portions over its surface. It is evident that a barrier on the surface of the layer 4, as well as on that of the layer 12 may be a combination one (that is, a p-n junction is provided on part of the surface of the layer 4 (12), and a Schottky barrier, on another part of the same surface), and the p-n junction may be a heterojunction.

Figure 7:
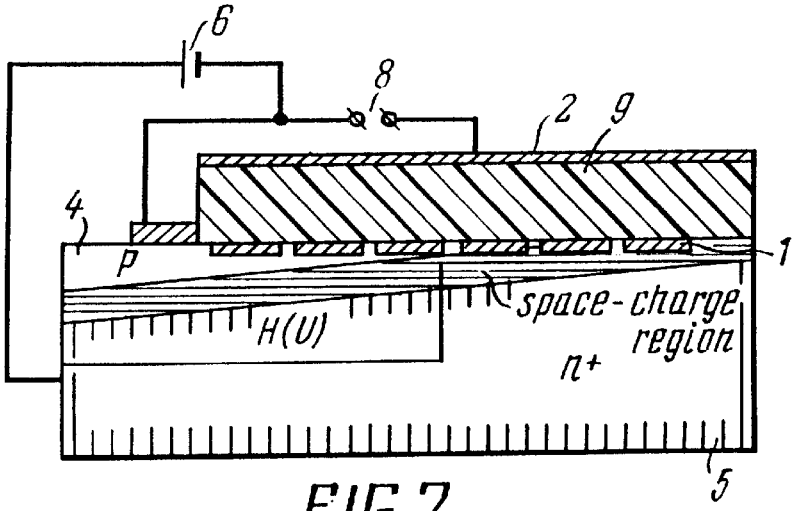
FIG. 7 illustrates a fragment of the transmission line having a wedge-shaped p-n junction.
Figure 8:
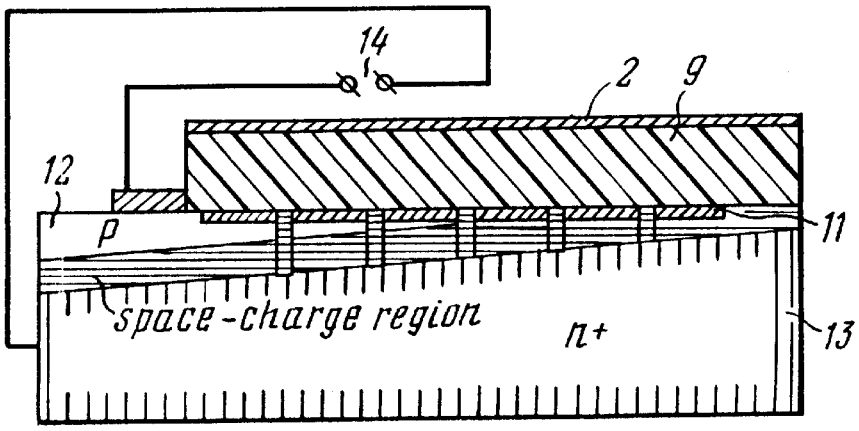
FIG. 8 illustrates the wedge-shaped p-n junction of a transmission line, provided above the clearances between conductor areas and conductors.

A p-n junction having a modulation-doped profile over the layer surface may be realized in particular in cases where the film 4 (12) is wedge-shaped. FIG. 7 shows a fragment of the transmission line having a wedge-shaped p-n junction which is made on a wedge-shaped p-type film 4 on an n-type substrate. An ohmic contact with the film 4 is made in aluminum, and conductor areas 1 are provided on the film surface, an insulator layer 9 being established above said conductor areas, which insulator layer carrying a conductor 2 formed thereon. The film thickness decreases lengthwise the direction Z. As the blocking voltage U of a source 6 increases at the junction, the size of the neutrality region (H(U) in the n-type semiconductor along the direction Z decreases continuously. FIG. 8 illustrates the arrangement of the transmission line featuring two control voltages (see also FIG. 6), said line comprising a p-n junction with an n-type wedge-shaped film 12 established on a p+-type substrate 13. An ohmic contact with the film is made in aluminum, conductor areas 11 are provided on the film surface, an insulator layer 9 being established above said conductor areas, said insulator layer carrying a common conductor 2 formed thereon. The film confined between the conductors 11 either is lightly doped or insulator areas are formed between said conductors, which areas insulate the conductors 11 from one another.

Figure 9:
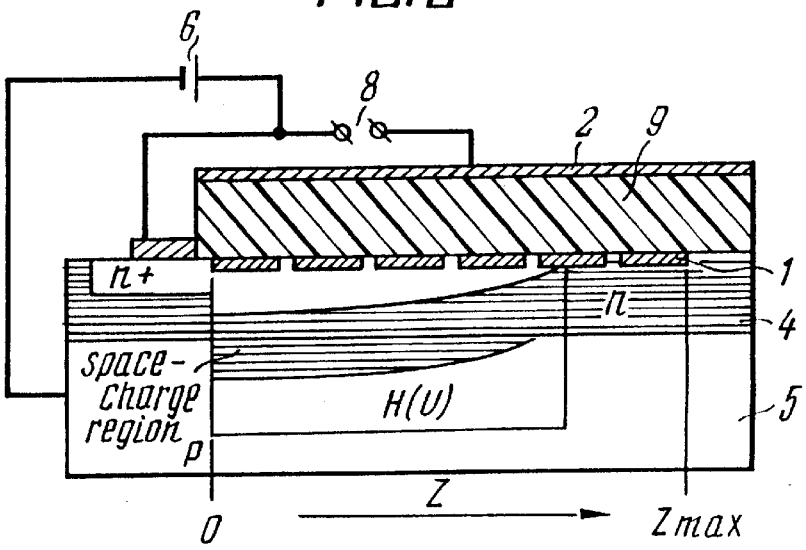
FIG. 9 illustrates a transmission line having a p-n junction on a modulation-doped substrate.

FIG. 9 exemplifies a transmission line having a p-n junction on a modulation-doped substrate. A p-n junction having a modulation-doped profile along its surface can be realized, in particular, when the film is doped uniformly along its surface, while the substrate is modulation-doped along its surface. FIG. 9 illustrates also another p-n junction having a modulation-doped substrate and used in a transmission line. The p-n junction comprises a substrate having the degree of doping increasing along the superficial direction Z. A homogenous film 4 is established on a substrate 5 having an opposite-type conductivity. The space-charge region is thicker in that substrate portion which is doped lighter, whereby an inhomogenous-thickness neutrality region is formed in the film. As the blocking voltage U (of a source 6) at the p-n junction increases, the size of the neutrality region (H(U) in the n-type semiconductor along the direction Z decreases continuously, with the result that still lesser number of the conductor areas 1 are connected through the neutrality region.

Figure 10:
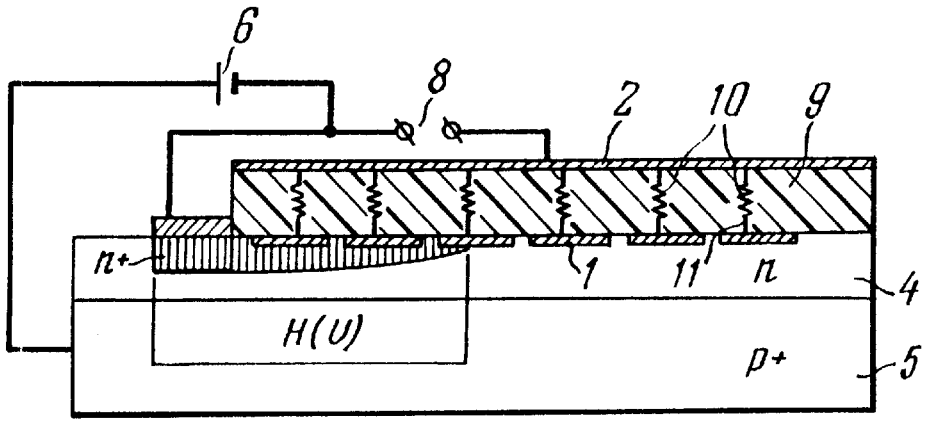
FIG. 10 illustrates one of the variants of practical application of the transmission line as a switching device.

The proposed transmission line may also be used as a switching device, when each of the strips 1 at the transmission line output is connected, through an individual load, to the input signal source which is connected to the ohmic contact with a layer 4 and a conductor 2. FIG. 10 exemplifies a transmission line used as a switching device. The line comprises a semiconductor layer 4 established on an opposite-type conductivity substrate 5. Conductor areas 1 are established on the surface of the layer 4 and are connected, via conductors 11, to the conductor 2, which in turn is insulated from the conductor areas 1 with an insulator layer 9. As the blocking voltage U (of a control voltage source 6) at said p-n junction increases, the size along the direction intersecting the strips 1 of the neutrality region in the semiconductor 4 decreases continuously, whereby the number of loads connected to the input signal source (a permanent one inclusive) through the neutrality region of the semiconductor film 4 and the strips 1 decreases, too. In particular, when loads 10 are inductive, the switching device can be used as a voltage-controlled inductance, and when the loads 10 are capacitive, it can be used as a voltage-controlled resistor. Used as the load can be distributed-parameter load (such as a volume-resistance wafer). Transmission lines present in FIG. 6 can be used as a switching device (FIG. 11) when each of the strips 1 at the line output is connected, through an individual load), to the input signal source, while the type of load and the number of loads are selected using the values of the control voltages U and $U_2$ of the respective sources 6 and 14. In addition, the load value can be modulated, using variable control voltage sources.

EXEMPLARY EMBODIMENTS OF THE INVENTION

Figure 11:
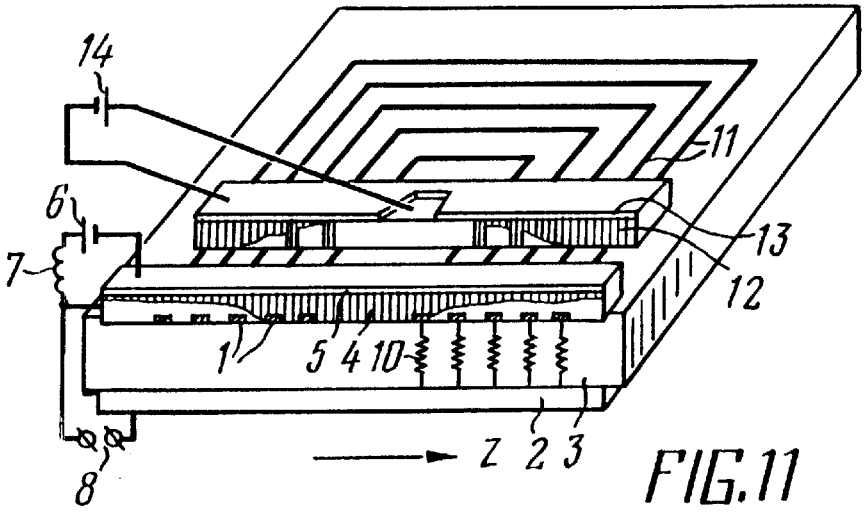
FIG. 11 illustrates another possible variant of practical application of the transmission line as a switching device.
Figure 12:
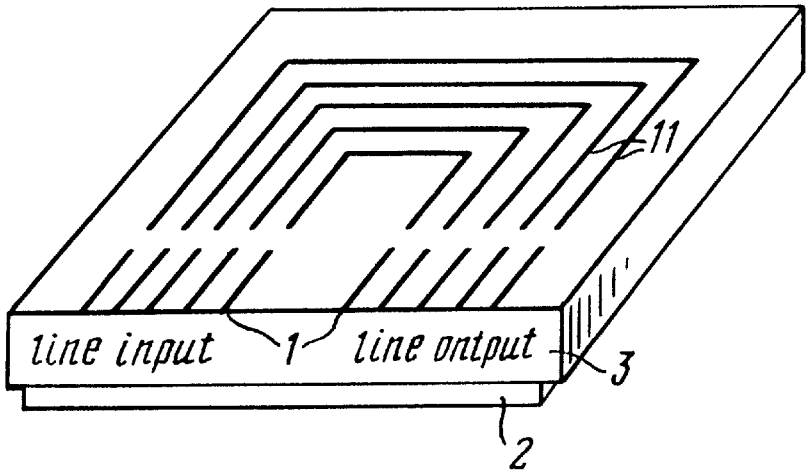
FIG. 12 illustrates a fragment of a manufactured transmission line having controlled characteristic impedance and length.
Figure 13:
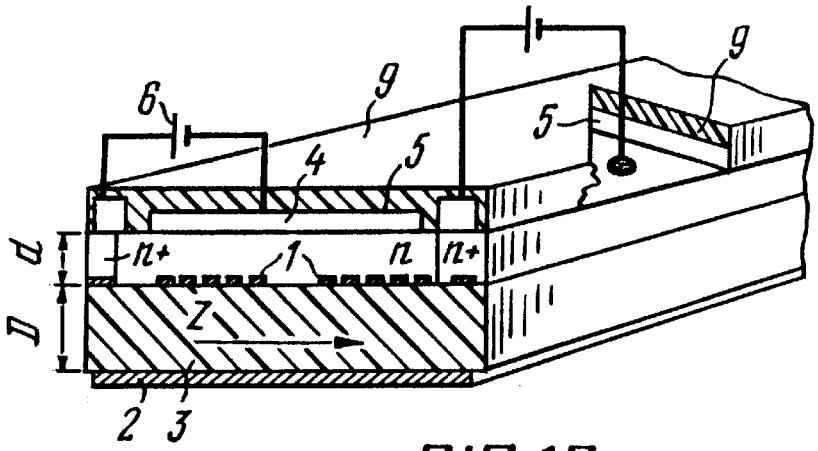
FIG. 13 is a full view of a manufactured transmission line having controlled characteristic impedance and length.

A total of 100 strips 1 each 40-um wide were established on a 0.5-mm thick silicon-dioxide substrate 3 (D=0.5 mm). The longest strip was 40 mm, the shortest one, 15 mm. A number of holes 50-um wide (FIG. 12) were made in the strips. A polysilicon layer 4 0.6 um thick was formed above the strips at the beginning and end of the line, said layer having a donor concentration of impurities of about $10^{15}$ $1/cm^3$. A modulation-doped impurity profile was formed in the layer 4, using ion implantation of phosphorus with a 200 keV energy, so that the ion-implantation dosage varied linearly across the line width (i.e., along the direction Z) from $1\cdot10^{12}$ to $2.5\cdot10^{11}$ ion/cm$^2$. As shown in FIG. 11, the degree of film doping is increased in this case at the line output along the direction Z (as the value of Z rose) and dropped at the line input along the direction Z, whereas the degree of film doping in increased at the line input along the direction Z (as the value of Z increased) and dropped from $1\cdot10^{12}$ to $2.5\cdot10^{11}$ ion/cm$^2$ at the line input in layer 4 along the direction Z; the film (layer 4) was not doped further in the interspaces between the strips. The Schottky barrier 5 was formed over the polysilicon layer by depositing an aluminum metallization layer. An ohmic contact with the polysilicon layer was made also of aluminum by depositing said metal on a preformed heavily doped portion of said polysilicon layer. Once wire leads had been made, the surface of the device was coated with a protective silicon dioxide layer 9. The conductor area 2 was established on the other side of the aluminum substrate. FIG. 13 presents a manufactured transmission line having controlled characteristic impedance and length.

The characteristic impedance ($Z_c$) of a transmission line is found from the following formulas (cf. "Computer-aided design of microwave-frequency devices" by K. Gupta, R. Garge, and R. Chadha, Moscow, Radio i Sviaz Publishers, 1987, pp. 41–42 (in Russian):

$$Z_c=C/(2\pi\epsilon^{1/2})\ ln\ (8D/W+0.25W/D) if\ W/D\leqq 1;$$

$$Z_c=C/\epsilon^{1/2}[W/D+1.393+0.667\ ln(W/D+1.444)]^{-1}\ if\ W/D>1;$$

$$\epsilon=(\epsilon_1+1)/2+(\epsilon_1-1)/2[(1+10D/W)^{-1/2}],$$

where W is the transmission line width;

$\epsilon_1$ is relative permittivity of silicon dioxide;

C=120π Ohm.

Figure 14:
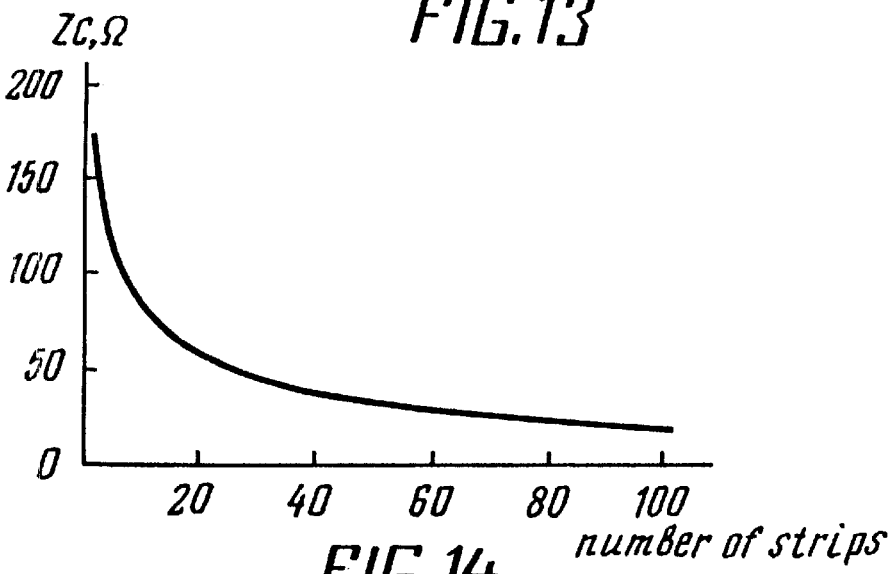
FIG. 14 illustrates a design-basis relation between transmission line characteristic impedance and the number of strips incorporated therein.

A design-basis relation between transmission line characteristic impedance and the number of strips incorporated therein is present in FIG. 14.

Figure 15:
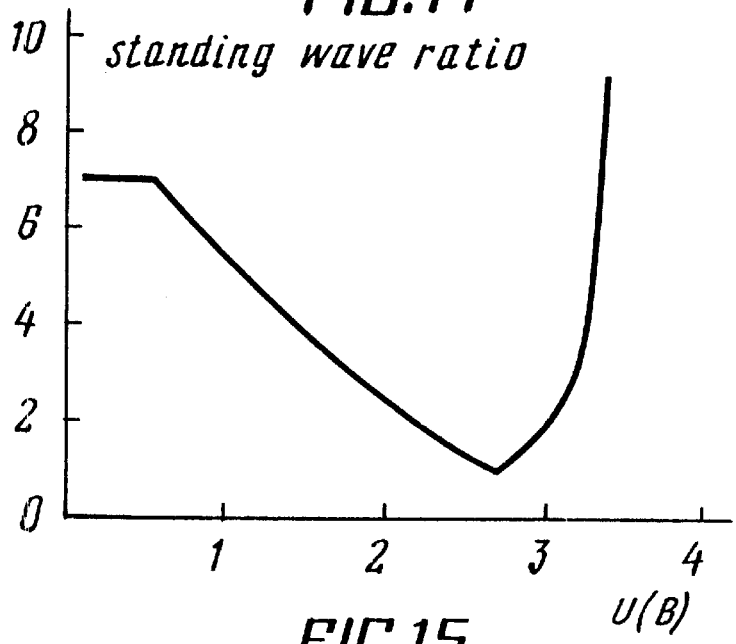
FIG. 15 illustrates an experimentally found relationship between transmission line standing wave ratio and voltage.

FIG. 15 presents the relationship between the standing wave ratio and voltage in a slotted line having a characteristic impedance of 50 Ohm with a blocking voltage of the source 14 equal to about 0.5 V, one end of said slotted line being connected to the source of an input signal having a frequency of 1.2 GHz and an internal resistance of 50 Ohm, while the other end thereof is connected to a transmission line loaded with a 50-Ohm load. The length of the transmission line changes by 1.8 times in response to a variation of the voltage of the source 14 from 0 to 3 V.

Thus, the present invention makes possible creating transmission lines having controlled characteristic impedance and length, using relatively simple technologies.

INDUSTRIAL APPLICABILITY

The invention can find application in the electronic industry.

What is claimed is:

1. A transmission line having characteristic impedance and length, comprising:

a plurality of twin transmission lines;

conductors of said transmission lines, at least one of which is common;

conducting areas located at the beginning of said transmission line, at the end of said transmission line, or at both ends in contact with the conductors which are not common;

a semiconductive layer having a surface in ohmic contact with said conducting areas, said layer having an electronic or hole-type conductivity with a pre-formed non-rectifying contact; and a layer selected from the group consisting of a semiconductor, a metal, and both a semi-conductor and a metal disposed on the surface of said semiconductive layer and in non-rectifying contact therewith, and forming, together with said semiconductive layer a barrier selected from the group consisting of a p-n junction, a Schottky barrier or both a p-n junction and a Schottky barrier and having a non-uniform doping profile in the direction of intersection with said conducting areas;

wherein said impedance and length of transmission line are controlled by the voltage values at the p-n junctions and/or Schottky barriers.

2. The transmission line according to claim 1 further comprising:

an insulator layer provided over said conducting areas and said ohmic contacts with said semiconductive layer.

3. The transmission line according to claim 1, further comprising:

an insulator layer provided between said ohmic contacts with said semiconductive layer.

4. A transmission line having characteristic impedance and length, comprising:

a plurality of twin transmission lines;

conductors of said transmission lines, at least one of which is common;

conducting areas located at the beginning of said transmission line, at the end of said transmission line, or at both ends in spaced relation to the conductors which are not common;

a semiconductive layer having a surface in ohmic contact with said conducting areas, said layer having an electronic or hole-type conductivity with a pre-formed non-rectifying contact; and a layer selected from the group consisting of a semi-conductor, a metal, a semi-conductor and a metal disposed on the surface of said semiconductive layer and in non-rectifying contact therewith, and forming, together with said semiconductive layer a barrier selected from the group consisting of a p-n junction, a Schottky barrier or both a p-n junction and a Schottky barrier and having a non-uniform doping profile in the direction of intersection with said conducting areas;

a second semiconductive layer disposed over the space between said conducting areas (1) and said conductors, said second semiconductive layer having electronic or hole-type conductivity with a non-rectifying contact;

a barrier selected from the group consisting of a p-n junction, a Schottky barrier and both a p-n junction and a Schottky barrier, said barrier being established on said surface of said second semiconductive layer and in non-rectifying contact therewith and having a non-uniform doping profile in the direction of intersection with said conducting areas;

wherein said impedance and length of transmission line are controlled by the voltage values at the p-n junctions and/or Schottky barriers.

5. The transmission line according to claim 4, further comprising:

an insulator layer provided over said conducting areas and said ohmic contacts with said semiconductive layer.

6. The transmission line according to claim 4, further comprising:

an insulator layer provided between said ohmic contacts with said semiconductive layer.

* * * * *